United States Patent [19]

Ichisaka et al.

[11] 4,194,670

[45] Mar. 25, 1980

[54] METHOD OF MAKING A BIPOLAR ELECTRODE

[75] Inventors: Teruo Ichisaka; Tadao Ikegami, both of Tamano, Japan

[73] Assignee: Chlorine Engineers Corp., Ltd., Tokyo, Japan

[21] Appl. No.: 950,114

[22] Filed: Oct. 10, 1978

Related U.S. Application Data

[62] Division of Ser. No. 886,862, Mar. 15, 1978, Pat. No. 4,141,815.

[30] Foreign Application Priority Data

Aug. 24, 1977 [JP] Japan ..... 52-100633

[51] Int. Cl.[2] ..... C25B 11/00; B23K 31/02

[52] U.S. Cl. ..... 228/179; 228/213

[58] Field of Search ..... 228/179, 213

[56] References Cited

U.S. PATENT DOCUMENTS

| | | | |
|---|---|---|---|
| 3,824,173 | 7/1974 | Bouy et al. | 204/256 X |
| 4,116,805 | 9/1978 | Ichisaka et al. | 204/268 X |

*Primary Examiner*—Francis S. Husar

*Assistant Examiner*—K. J. Ramsey

*Attorney, Agent, or Firm*—Sughrue, Rothwell, Mion, Zinn and Macpeak

[57] ABSTRACT

A bipolar electrode comprising (a) an electrode frame;

(b) a partition wall welded to the electrode frame (a) and comprising a composite structure of an anode-side sheet and a cathode-side sheet;

(c) an anode plate disposed on the anode-side of the partition wall (b);

(d) a cathode plate disposed on the cathode-side of the partition wall (b); and (e) electrically conductive spacers with both ends welded to the anode plate (c) and the anode-side sheet of the partition wall (b) and to the cathode plate (d) and the cathode-side sheet of the partition wall (b), wherein each of the electrically conductive spacers (e) comprises two elements which are superimposed between the anode plate (c) or the cathode plate (d) and the partition wall (b) and welded at the superimposed surface, so as to form the anode plate (c) and the cathode plate (d) as horizontal uniform planes and a method for the production of the bipolar electrode.

1 Claim, 3 Drawing Figures

METHOD OF MAKING A BIPOLAR ELECTRODE

This is a division of application Ser. No. 886,862 filed Mar. 15, 1978 now U.S. Pat. No. 4,141,815 issued Feb. 27, 1979.

BACKGROUND OF THE INVENTION

1. Field of the Invention

This invention relates to a bipolar electrode which comprises an anode plate and a cathode plate separated from each other by a partition wall and electrically and structurally connected to each other, and which is suitable for electrolyzing an aqueous solution of an alkali metal chloride, etc. for the production of alkali metal chlorates or alkali metal hydroxides and chlorine, and to a method for the production of the bipolar electrode.

2. Detailed Description of the Prior Art

A conventional bipolar electrode is disclosed in U.S. Pat. No. 3,859,197 and has the structure shown in FIG. 1. In FIG. 1, reference numeral 1 represents a composite member obtained by explosive welding of a titanium plate 4 and a mild steel plate 5. The composite member 1 is fitted in an opening of a partition wall 12 composed of a titanium sheet 2 and a mild steel sheet 3 so that it forms a part of the partition wall 12. The outer edge of the titanium plate 4 of the composite member 1 is welded to an opening in the titanium sheet 2, and the outer edge portion of the mild steel plate 5 is welded to an opening in the mild steel sheet 3.

The titanium plate 4 of the composite member 1 is welded to an anode plate 7 in which titanium is a substrate thereof through a titanium spacer 6 welded to the plate 4, and the mild steel plate 5 of the composite member 1 is welded to a cathode plate 9 by means of a spacer 8 of mild steel welded to the plate 5. Thus, the anode plate 7 and the cathode plate 9 are connected electrically and structurally by the composite member 1 to form a bipolar electrode having an anode compartment 10 and a cathode compartment 11.

In conventional bipolar electrodes of this kind, the anode plate and the cathode plate are connected to the partition wall or the composite member through spacers. Since the spacers are first welded to both surfaces of the partition wall or the composite member and then the anode plate and the cathode plate are welded to the fixed spacers, it is difficult to maintain the anode plate and the cathode plate as horizontal uniform planes. In particular, since the distances to the electrode plates differ between that portion of the partition wall at which the composite member is present and the other portion of the partition wall, a difference tends to occur in the interelectrode space between the site of the spacer on the composite member and the site of the spacer on the partition wall.

In this way, the anode plate and the cathode plate in conventional bipolar electrodes form non-uniform planes, and the distance between the opposing anode and cathode cannot be maintained uniform. Consequently, this causes the defect of a non-uniform distribution of electric current.

Another defect is that since the planes of the anode plate and of the cathode plate are non-uniform, the anode and the cathode cannot be brought sufficiently close to each other, and a large loss of voltage occurs in the electrolytic cell.

Furthermore, since the distribution of electric current is non-uniform, a uniform reaction does not take place at the anode or cathode, but the reaction occurs vigorously at particular localities to cause localized heating effects. This leads to a shortening of the life of the electrodes.

SUMMARY OF THE INVENTION

An object of this invention is to provide a bipolar electrode which is free from these defects described above and in which the anode plate and the cathode plate are formed as horizontal uniform planes, and a method for the production thereof.

The present invention provides a bipolar electrode comprising (a) an electrode frame, (b) a partition wall welded to the electrode frame (a) comprising a composite structure of an anode-side sheet and a cathode-side sheet, (c) an anode plate disposed on the anode-side of the partition wall (b), (d) a cathode plate disposed on the cathode-side of the partition wall (b) and (e) electrically conductive spacers with both ends welded to the anode plate (c) and the anode-side sheet of the partition wall (b) and to the cathode plate (d) and the cathode-side sheet of the partition wall (b), wherein each of the electrically conductive spacers (e) comprises two elements which are superimposed between the anode plate (c) or the cathode plate (d) and the partition wall (b) and welded at the superimposed surface thereof, so as to form the anode plate (c) and the cathode plate (d) as horizontal uniform planes.

DESCRIPTION OF THE PREFERRED EMBODIMENTS

Figure 2:
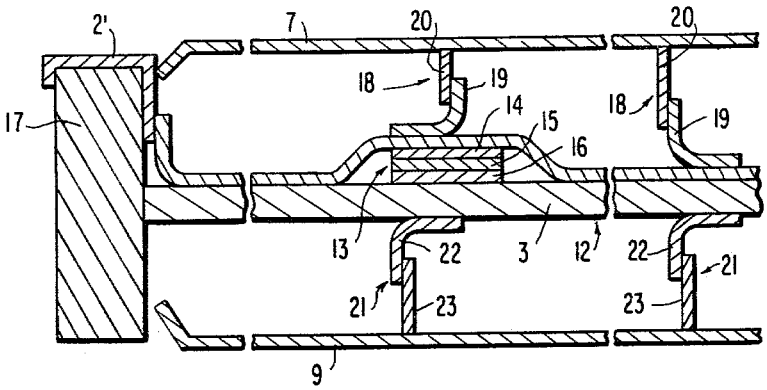
FIG. 2 is a partial cross-sectional view showing one embodiment of the bipolar electrode of this invention.

FIG. 2 is a partial cross-sectional view showing one embodiment of the bipolar electrode of this invention. Referring to FIG. 2, reference numeral 17 is a picture frame-like electrode frame which is made of, for example, mild steel. Titanium can also be used as the electrode frame. A partition wall 12 comprises a composite structure of an anode-side sheet 2 and a cathode-side sheet 3. The partition wall 12 is welded to the electrode frame 17. At a portion 2', the anode-side sheet 2 is fixed to the electrode frame 17. The members 2 and 2' may be formed as a single continuous sheet. A composite member 13 is a triple clad material composed of a portion 14 made of the same type of metal or metal alloy used as the anode-side sheet, e.g., a metal such as titanium or a titanium alloy, a portion 15 made of an electrically conductive material resistant to atomic hydrogen migration, such as copper, gold, tin, lead, nickel, cobalt, chromium, tungsten, molybdenum and cadmium, and alloys of these metals and a portion 16 made of the same type of metal or metal alloy used as the cathode-side sheet, e.g., mild steel or the like.

Figure 1:
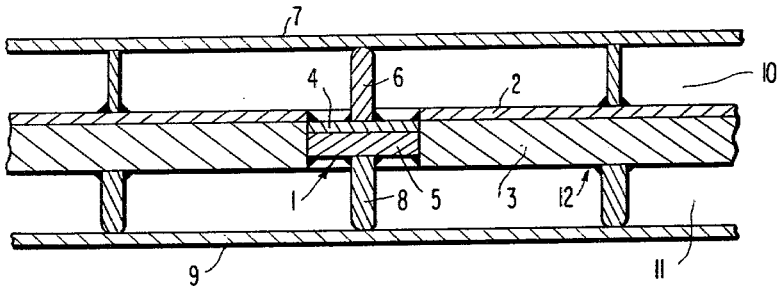
FIG. 1 PRIOR ART
FIG. 1 is a cross-sectional view of a bipolar electrode of the prior art.

In the bipolar electrode of this invention, the structure of the composite member or the method of forming such is not limited, and the invention can be applied also to the structure shown in FIG. 1 in which the composite member is connected to the partition wall by insertion. Since, however, the difference in interelectrode distance is large between that portion of the partition wall where the composite member is present and the other portion of the partition wall in the structure shown in FIG. 2, the structure in accordance with this invention is especially effective.

An anode plate 7 and a cathode plate 9 are disposed with the partition wall 12 therebetween. The anode plate 7 and the anode-side sheet 2 of the partition wall are connected to each other through an electrically conductive spacer 18, which can be made of the same type of metal or metal alloy as used for the anode-side sheet or the anode plate substrate, having both sides welded thereto; and likewise, the cathode plate 9 and the cathode-side sheet 3 of the partition wall 12 are connected to each other through an electrically conductive spacer 21, which can be made of the same type of metal or metal alloy as used for the cathode-side sheet or the cathode plate, having both ends welded thereto. In order that the anode plate 7 and the cathode plate 9 may form horizontal uniform planes, the electrically conductive spacer 18 is divided into an element 19 to be welded to the anode-side sheet 2 and an element 20 to be welded to the anode plate 7 which are superimposed and welded at the superimposed surface. Likewise, the electrically conductive spacer 21 is divided into an element 22 to be welded to the cathode-side sheet 3 and an element 23 to be welded to the cathode plate 9 which are superimposed and welded at the superimposed surface. By dividing each spacer and welding the superimposed separate spacer elements while adjusting the position of the part to be welded of the divided spacers, the anode plate and the cathode plate can be formed as horizontal uniform planes.

The divided spacers may have various shapes. From the standpoint of mechanical strength, as shown in FIG. 2, it is preferred that the spacer elements 19 and 22 to be welded to the anode-side sheet 2 and the cathode-side sheet 3 be L-shaped, and the other spacer elements 20 and 23 be plate-shaped.

The substrate of the anode plate 7, the anode-side sheets 2 and 2' and the electrically conductive spacer 18 on the anode side are made of a material which is corrosion resistant to the anolyte solution, such as titanium. Since the anode-side sheet 2' at the portion in contact with the electrode frame 17 tends to corrode at small interstices, it is desirable to make the anode-side sheet 2' from a palladium-containing titanium alloy or titanium whose surface has been diffusion treated with palladium, for example. The cathode plate 9, the cathode-side sheet 3 and the electrically conductive spacer 21 on the cathode side are made of a material such as mild steel which is corrosion resistant to the catholyte solution.

More specifically, the anode plate in the embodiments of this invention described herein comprises a substrate made of an anticorrosive metal or metal alloy and an electrically conductive coating formed on the surface thereof. A suitable substrate metal or metal alloy is typically titanium, but tantalum, niobium, hafnium, and zirconium and alloys where one or more of these metals predominate can also be used. Suitable materials for the cathode plate in the embodiments described herein include electrically conductive metals which are resistant to chemical corrosion when used as a cathode. Metals such as iron, aluminum, nickel, lead, tin and zinc, alloys of these metals and alloys such as mild steel, stainless steel, bronze, brass, monel and cast iron, commonly mild steel, can be used as the cathode plate. Suitable anode-side sheet materials which can be used include the same type of metals or metal alloys as used for the substrate of the anode plate, for example, titanium, tantalum, niobium, hafnium, zirconium and alloys thereof. Suitable cathode-side sheet materials which can be used include the same type of metals or metal alloys used as the cathode plate as described above.

The method for producing the bipolar electrode of this invention comprises (i) welding one of two conductive spacer elements to predetermined parts of the cathode-side sheet and the anode-side sheet of a partition wall;
(ii) welding the peripheral part of the cathode-side sheet to an intermediate part of the electrode frame;
(iii) lining the anode-side sheet on the cathode-side sheet and fixing the peripheral part of the anode-side sheet to the periphery of the electrode frame;
(iv) superimposing the other electrically conductive spacer element on one electrode spacer element and adjusting this electrically conductive spacer element so that the end surface thereof becomes horizontal, and welding the superimposed surface; and
(v) welding the anode plate and the cathode plate to one end surface of the other electrode spacer element.

Figure 3:
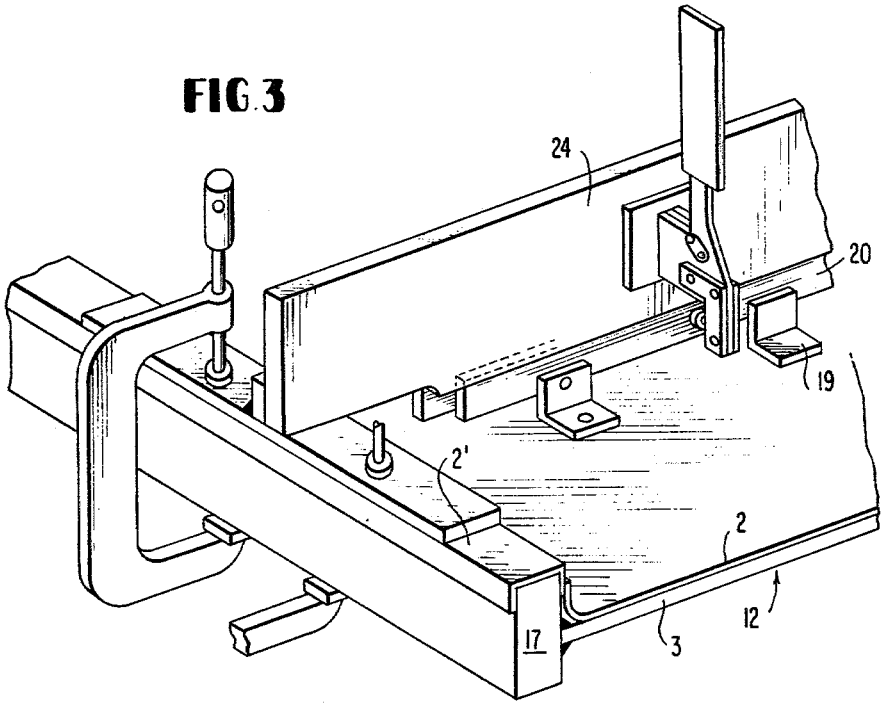
FIG. 3 shows one example of the method for producing the bipolar electrode in accordance with this invention.

FIG. 3 shows one example of the method for producing the bipolar electrode in accordance with this invention, FIG. 3 is a perspective view of the anode side. In FIG. 3, a partition wall 12 is composed of an anode-side sheet 2 and a cathode-side sheet 3 in a composite structure. Reference numeral 19 represents an L-shaped electrically conductive spacer element which is to be welded to a predetermined part of the anode-side sheet 2. Although not shown in FIG. 3, an L-shaped electrically conductive spacer element is also welded to a predetermined part of the cathode-side sheet 3. Then, the peripheral part of the cathode-side sheet 3 is welded to an intermediate part of an electrode frame 17, and the anode-side sheet 2 is lined on the cathode-side sheet 3 and the peripheral part of the anode-side sheet 2' is fixed to the peripheral part of the electrode frame 17.

Then, another plate-like electrically conductive spacer element 20 is held by a fixing jig 24 to keep the end surface thereof horizontal, and superimposed on the electrically conductive spacer element 19, after which the superimposed surface is welded. Although not shown in FIG. 3, a plate-like electrically conductive sapcer element for the cathode side is fixed in the same way.

Subsequently, the anode plate and the cathode plate are welded to one end surface of the plate-like electrically conductive spacer element.

Since in the bipolar electrode of this invention, the anode plate and the cathode plate can be formed as horizontal uniform planes, the distance between the opposing anode and cathode can be maintained constant, and a uniform distribution of electric current can be obtained. Furthermore, since the opposing anode and cathode can be brought closer to each other, a sufficient decrease in voltage can be achieved. Furthermore, since a uniform distribution of electric current can be obtained, a uniform electrode reaction takes place on the entire surface of the electrode, and no localized heating effect is produced, thus making it possible to prolong the life of the electrode.

According to the method for producing the bipolar electrode in accordance with this invention, a bipolar electrode having an anode plate and a cathode plate formed as horizontal uniform planes can be obtained easily and surely.

While the invention has been described in detail and with reference to specific embodiments thereof, it will be apparent to one skilled in the art that various changes and modifications can be made therein without departing from the spirit and scope thereof.

We claim:

1. A method for producing a bipolar electrode of the type having an electrode frame, a partition wall having a composite structure of an anode-side sheet and a cathode-side sheet, an anode plate disposed on the anode-side of said partition wall, a cathode plate disposed on the cathode-side of said partition wall, and a plurality of electrically conductive spacers, said method comprising the steps of:

(a) welding a first electrically conductive spacer element to a predetermined part of said cathode-side sheet, and welding a second electrically conductive spacer to a predetermined part of said anode-side sheet of said partition wall;

(b) welding a peripheral part of said cathode-side sheet to an intermediate part of said electrode frame;

(c) lining said anode-side sheet on said cathode-side sheet and fixing a peripheral part of said anode-side sheet to a periphery of said electrode frame;

(d) superimposing a third electrically conductive spacer element on said first electrically conductive spacer element and adjusting same so that an end surface of said third electrically conductive spacer element is horizontal, and welding a superimposed surface;

(e) superimposing a fourth electrically conductive spacer element on said second electrically conductive spacer element and adjusting same so that an end surface of said fourth electrically conductive spacer element is horizontal, and welding a superimposed surface; and (f) welding said cathode plate to said end surface of said third electrically conductive spacer element, and welding said anode plate to said end surface of said fourth electrically conductive spacer element.

* * * * *